US008342430B2

(12) United States Patent
Ohno et al.

(10) Patent No.: US 8,342,430 B2
(45) Date of Patent: Jan. 1, 2013

(54) FUEL INJECTION VALVE

(75) Inventors: Hiroshi Ohno, Honjyo (JP); Minoru Hyodo, Isesaki (JP); Nobuaki Kobayashi, Maebashi (JP)

(73) Assignee: Hitachi Automotive Systems, Ltd., Ibaraki (JP)

( * ) Notice: Subject to any disclaimer, the term of this patent is extended or adjusted under 35 U.S.C. 154(b) by 309 days.

(21) Appl. No.: 12/879,353

(22) Filed: Sep. 10, 2010

(65) Prior Publication Data

US 2011/0233307 A1 Sep. 29, 2011

(30) Foreign Application Priority Data

Mar. 23, 2010 (JP) ..... 2010-066554

(51) Int. Cl.
*F02M 61/00* (2006.01)

(52) U.S. Cl. ..... 239/533.12; 239/482

(58) Field of Classification Search ..... 239/533.12, 239/482, 461, 463, 475, 533.2, 585.1, 585.3, 239/585.4, 585.5, 584, 533.14
See application file for complete search history.

(56) References Cited

U.S. PATENT DOCUMENTS

| | | | | |
|---|---|---|---|---|
| 4,945,877 | A | 8/1990 | Ziegler et al. | |
| 6,065,692 | A * | 5/2000 | Brinn, Jr. | 239/533.12 |
| 6,168,098 | B1 * | 1/2001 | Brinn, Jr. | 239/585.4 |
| 6,202,936 | B1 * | 3/2001 | Frick | 239/5 |
| 6,257,496 | B1 * | 7/2001 | Wyant | 239/5 |
| 6,311,901 | B1 * | 11/2001 | Imoehl et al. | 239/533.2 |

FOREIGN PATENT DOCUMENTS

JP 2659789 6/1997

* cited by examiner

*Primary Examiner* — Davis Hwu
(74) *Attorney, Agent, or Firm* — Antonelli, Terry, Stout & Kraus, LLP.

(57) ABSTRACT

A fuel injection valve has a valve body, a valve seat member having a valve seat and an opening portion formed at a downstream side of the valve seat member, a swirl chamber providing swirl to fuel, an orifice nozzle formed at a bottom of the swirl chamber and jetting the fuel, a communication conduit connecting the swirl chamber and the opening portion of the valve seat member, and a fuel inflow prevention wall provided at a connecting area between the communication conduit and the swirl chamber. The fuel inflow prevention wall is formed so as to prevent an incoming fuel from the communication conduit from directly flowing into the orifice nozzle and to suppresse a collision between a flow of the fuel that swirls and comes to the connecting area and a fuel flow coming from the communication conduit.

8 Claims, 7 Drawing Sheets

FUEL INJECTION VALVE

BACKGROUND OF THE INVENTION

The present invention relates to a fuel injection valve used for an engine.

In recent years, there have been proposed and developed various fuel injection valves, and one such fuel injection valve has been disclosed in Japanese Patent No. 2659789 (hereinafter is referred to as "JP2659789"). In JP2659789, a fuel injection valve in which, a tangential conduit extends outwards from a central opening portion in a tangential direction of a swirl chamber, and a fuel metering opening to jet fuel is provided in a center of the swirl chamber, is disclosed.

SUMMARY OF THE INVENTION

In such a fuel injection valve in JP2659789, however, since a distance from a connecting point between the swirl chamber and the tangential conduit to the fuel metering opening is large, the fuel directly flows into the fuel metering opening from the tangential conduit, and also a collision between a fuel flow coming from the tangential conduit and a fuel flow swirling inside the swirl chamber occurs. Because of this, the fuel is jetted out from the fuel metering opening without being provided with a sufficient swirling energy, and there might arise a problem that a size of sprayed or atomized fuel particle becomes large.

For this problem, it is therefore an object of the present invention to provide a fuel injection valve which is capable of facilitating the generation of minute atomized fuel particles with the sufficient swirling energy given to the jetted fuel.

According to one aspect of the present invention, a fuel injection valve comprises: a valve body; a valve seat member which slidably accommodates therein the valve body and has (a) a valve seat on which the valve body is seated during valve closure; and (b) an opening portion formed at a downstream side of the valve seat member; a swirl chamber which is formed into a circular hollow shape at a downstream side of the opening portion of the valve seat member and has a cylindrical inner side surface, the swirl chamber providing swirl to fuel; an orifice nozzle which is formed into a cylindrical shape at a bottom of the swirl chamber, and from which the fuel is jetted; a communication conduit through which the swirl chamber communicates with the opening portion of the valve seat member, the communication conduit extending toward a tangential direction of the swirl chamber and connecting with the swirl chamber; and a fuel inflow prevention wall which is provided at a connecting area between the communication conduit and the swirl chamber. And when setting a first connecting point, a second connecting point, a first straight line, a second straight line and a third straight line, viewed from an axial direction of the swirl chamber, in the swirl chamber, as follows; the first connecting point is a connecting point between the communication conduit and the inner side surface of the swirl chamber on a tangent of the swirl chamber, the second connecting point is a connecting point between the communication conduit and the inner side surface of the swirl chamber, which differs from the first connecting point, the first straight line is a tangent of the orifice nozzle, which is perpendicular to a direction of the tangent of the inner side surface of the swirl chamber on the first connecting point and is closer to the second connecting point, the second straight line is a straight line which passes through the second connecting point and is perpendicular to the direction of the tangent of the inner side surface of the swirl chamber on the first connecting point, and the third straight line is a tangent of the orifice nozzle, which is parallel to the direction of the tangent of the inner side surface of the swirl chamber on the first connecting point and is closer to the first connecting point, the orifice nozzle is positioned at a center side with respect to the second straight line in the swirl chamber, and the fuel inflow prevention wall is set at a first connecting point side with respect to the third straight line with the fuel inflow prevention wall extending from the first straight line to the second straight line.

According to the present invention, the jetted fuel is provided with the sufficient swirling energy, and the generation of minute atomized fuel particles is facilitated.

The other objects and features of this invention will become understood from the following description with reference to the accompanying drawings.

DETAILED DESCRIPTION OF THE INVENTION

Embodiments of the present invention will be explained below with reference to the drawings.

Embodiment 1

A fuel injection valve 1 of an embodiment 1 will be explained.

[Configuration of the Fuel Injection Valve]

Figure 1:
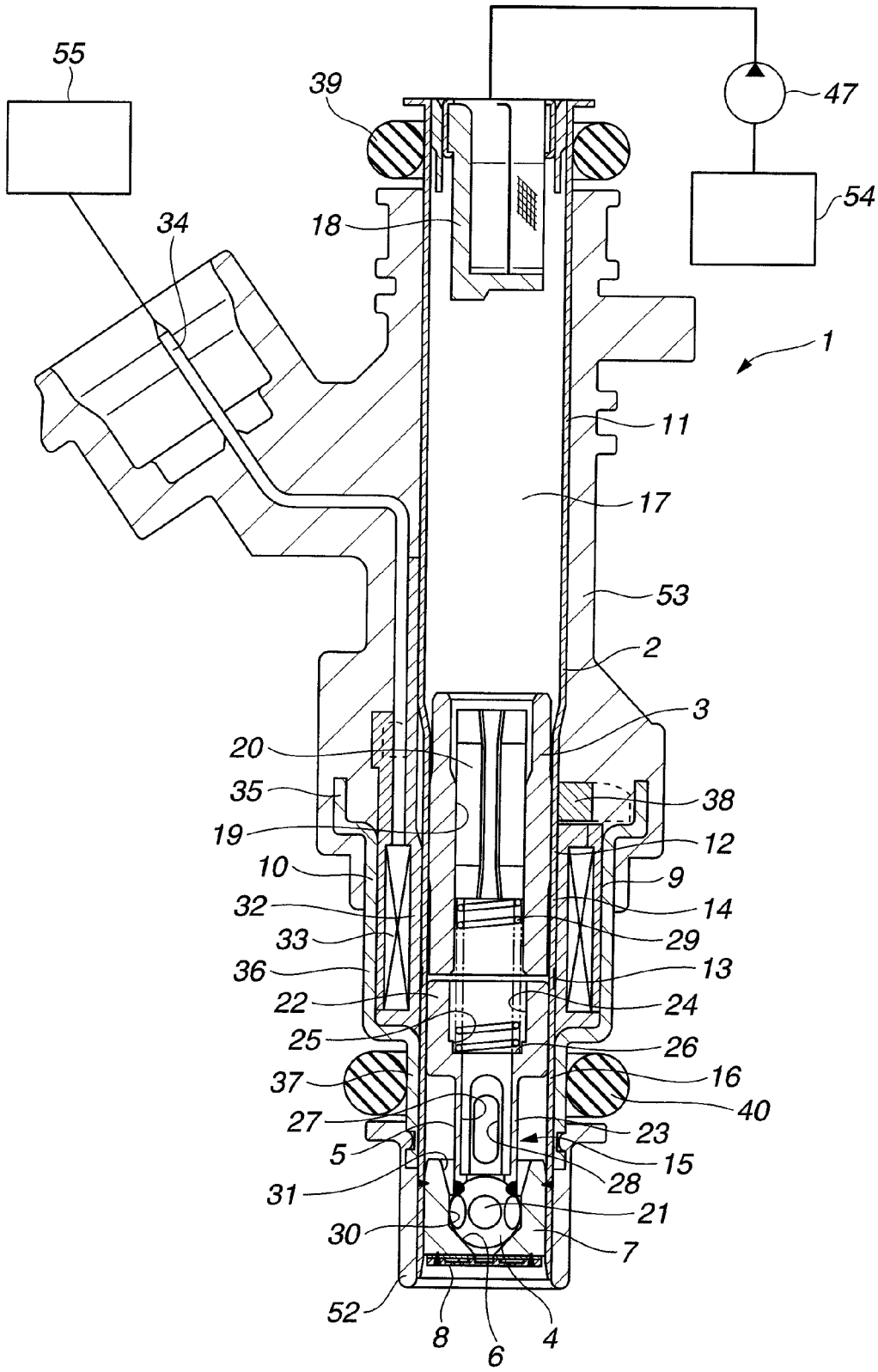
FIG. 1 is a longitudinal cross section in an axial direction of a fuel injection valve, according to an embodiment 1.
Figure 2:
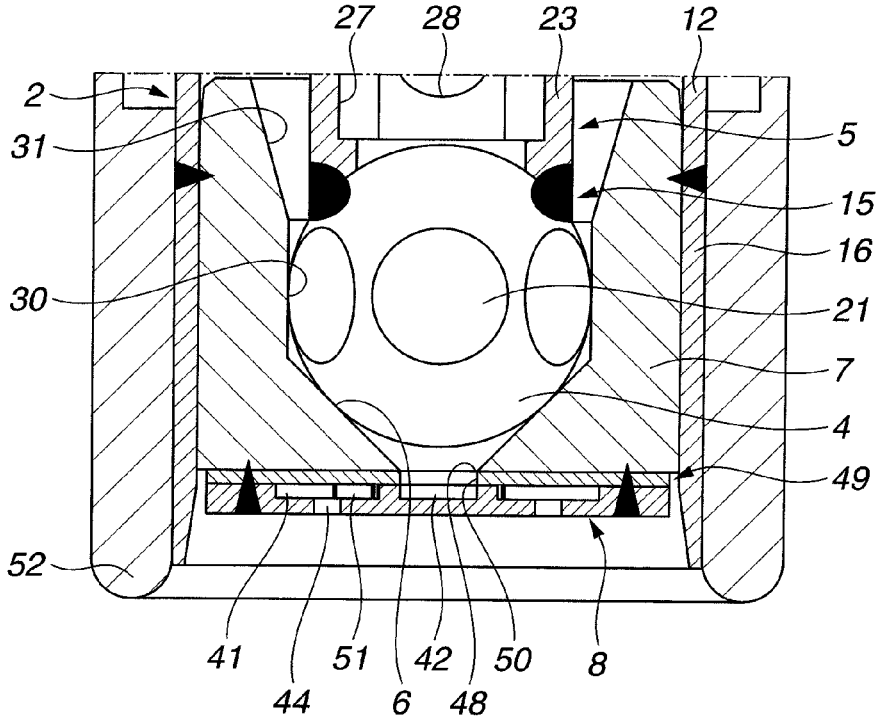
FIG. 2 is an enlarged sectional view around a nozzle plate of the fuel injection valve, of the embodiment 1.

FIG. 1 is a longitudinal cross section in an axial direction of the fuel injection valve 1. FIG. 2 is an enlarged sectional view around a nozzle plate 8 of the fuel injection valve 1.

This fuel injection valve 1 is a fuel injection valve used in an engine for a vehicle. In the fuel injection valve 1, fuel pumped up by a pump 47 is fed into a fuel passage 17 that is formed inside a magnetic cylinder 2 through a fuel filter 18. Then when a valve body 4 opens, atomized fuel is jetted in a combustion chamber of the engine from an orifice nozzle 44 (see FIG. 2) of the nozzle plate 8 through a gap between the valve body 4 and a valve seat 6 of a valve seat member 7.

In the following description, a fuel filter 18 side of the fuel injection valve 1 is described as an upstream side. A nozzle plate 8 side of the fuel injection valve 1 is described as a downstream side.

The fuel injection valve 1 has the magnetic cylinder 2, a core cylinder 3 that is accommodated inside the magnetic cylinder 2, the valve body 4 that can slide or move in the axial direction, a valve stem 5 that is fixedly connected to the valve body 4, the valve seat member 7 having the valve seat 6 that is closed by the valve body 4 at valve closure (i.e. the gap between the valve body 4 and the valve seat 6 are closed at valve closure), the nozzle plate 8 having the cylindrical orifice nozzle 44 from which the fuel is jetted at the valve open, an electromagnetic coil 9 that moves the valve body 4 in a valve opening direction upon energization, and a yoke 10 that induces line of magnetic flux.

The magnetic cylinder 2 is formed by, for example, a metal pipe that is made of magnetic metal material such as an electromagnetic stainless steel. The magnetic cylinder 2 is provided with a step-bore which is formed integrally with a non-step-bore, as shown in FIG. 1, through press working such as deep-drawing and through grinding etc. . . . The magnetic cylinder 2 has a large diameter part 11 that is formed at the upstream side and a small diameter part 12 whose diameter size is smaller than the large diameter part 11 and which is formed at the downstream side.

The small diameter part 12 has a thinner part 13 that is formed by thinning a part of the small diameter part 12. The small diameter part 12 is divided into two parts. One is a core cylinder accommodating part 14 and the other is a valve member accommodating part 16. The core cylinder accommodating part 14 is positioned at the upstream side of the thinner part 13 and accommodates therein the core cylinder 3. The valve member accommodating part 16 is positioned at the downstream side of the thinner part 13 and accommodates therein a valve member 15 (the valve body 4, the valve stem 5 and the valve seat member 7).

The thinner part 13 is formed so as to encircle a gap portion between the core cylinder 3 and the valve stem 5 with the core cylinder 3 and the valve stem 5 accommodated inside the magnetic cylinder 2 (which is described later). The thinner part 13 increases magnetic resistance between the core cylinder accommodating part 14 and the valve member accommodating part 16, then interrupts a magnetic connection between both the core cylinder accommodating part 14 and the valve member accommodating part 16.

The large diameter part 11 forms the fuel passage 17 that feeds the fuel to the valve member 15. The large diameter part 11 is provided, at the upstream side of the large diameter part 11, with the fuel filter 18 that filters the fuel. As seen in FIG. 1, the pump 47 is connected to the fuel passage 17. The pump 47 is controlled by a pump controller 54.

The core cylinder 3 is formed into a cylindrical shape and has a hollow portion 19 therein. The core cylinder 3 is press-fitted into the core cylinder accommodating part 14 of the magnetic cylinder 2. The hollow portion 19 accommodates therein a spring bearing 20 with the spring bearing 20 fixed in the hollow portion 19 by means of the press-fitting etc. . . .

An outside shape of the valve body 4 is a substantially sphere shape, and the valve body 4 has, on its circumferential surface, fuel passing surfaces 21 which are cut parallel to the axial direction of the fuel injection valve 1. The valve stem 5 has a large diameter portion 22 and a small diameter portion 23 whose outside shape is smaller than the large diameter portion 22.

As can be seen in FIG. 2, a top end of the small diameter portion 23 is integrally fixed to the valve body 4 through welding. In the drawings, shaded semicircles and shaded triangles indicate welding points.

At an end portion of the large diameter portion 22, a spring insertion bore 24 is formed. More specifically, at a bottom of this spring insertion bore 24, a spring seat portion 25 whose diameter is smaller than the spring insertion bore 24 is formed, and also a stepped spring bearing portion 26 is formed.

Further, a fuel passing opening 27 is provided at an end portion of the small diameter portion 23. This fuel passing opening 27 communicates with the spring insertion bore 24. Furthermore, a fuel outflow opening 28 that penetrates an outer circumference of the small diameter portion 23 and the fuel passing opening 27 is provided.

The valve seat member 7 has substantially cylindrical appearance, and the substantially conical shaped valve seat 6 is formed inside the valve seat member 7. A diameter of an upstream side of the valve seat 6 is set to the substantially same diameter as a maximum diameter of the valve body 4. The upstream side of the valve seat 6 connects with or is next to a valve body holding hole 30 that is formed at the upstream side of the valve seat 6. A downstream side of the valve seat 6 is formed so that the valve body 4 is completely seated on the valve seat 6. More specifically, the downstream side of the valve seat 6 has such length that the valve body 4 is completely seated on the valve seat 6. An edge portion of the downstream side of the valve seat 6 connects with or is next to an opening portion 48. This opening portion 48 connects with a communication hole 50 of an after-mentioned mid-plate 49.

The valve body holding hole 30 is formed so that its diameter is set to the substantially same diameter as the maximum diameter of the valve body 4, same as the diameter of the upstream side of the valve seat 6. An upstream side of the valve body holding hole 30 connects with or is next to an opening part 31. As can be seen in FIG. 2, the opening part 31 has a substantially conical shape, and a diameter of a downstream side of the opening part 31 is the same diameter as the valve body holding hole 30. The opening part 31 is formed so that its diameter is larger as a position of the diameter get closer to an upstream side of the opening part 31.

The valve stem 5 and the valve body 4 are accommodated inside the magnetic cylinder 2 so that the valve stem 5 and the valve body 4 can slide in the axial direction, with a coil spring 29 provided between the spring bearing portion 26 of the valve stem 5 and the spring bearing 20. The valve seat member 7 is inserted into the magnetic cylinder 2 so that the valve body 4 is seated on the valve seat 6. The valve seat member 7 is fixed to the magnetic cylinder 2 through welding.

The mid-plate 49 and the nozzle plate 8 are set at a downstream side of the valve seat member 7. Each of the mid-plate 49 and the nozzle plate 8 is formed into a disc shape, and their respective outside diameters are formed to be slightly smaller than that of the valve seat member 7. The mid-plate 49 and the nozzle plate 8 are fixed to a downstream side surface of the valve seat member 7 through welding. The mid-plate 49 has the communication hole 50 that penetrates the mid-plate 49 in the axial direction. A diameter of the communication hole 50 is the same diameter as the opening portion 48 of the valve seat member 7.

On an upstream side of the nozzle plate 8, a plurality of swirl chambers 41, each of which provides swirl (flow of swirl) to the fuel, are formed. Also a fuel distribution chamber 42 which connects with each communication conduit 43 and distributes the fuel to each swirl chamber 41 is formed. On the other hand, on a downstream side of the nozzle plate 8, the orifice nozzle 44, from which the fuel provided with the swirl inside the swirl chamber 41 is jetted, is formed for each swirl chamber 41. With regard to the nozzle plate 8, its detailed structure will be explained later.

The electromagnetic coil 9 is wound or fitted around an outer circumference of the core cylinder 3 of the magnetic cylinder 2, namely that the electromagnetic coil 9 is arranged around the outer circumference of the core cylinder 3. The electromagnetic coil 9 has a bobbin 32 that is made of resin material and a coil 33 that is wound around the bobbin 32. The coil 33 is connected to an electromagnetic coil controller 55 through a connector pin 34. The electromagnetic coil controller 55 opens the fuel injection valve 1 by applying power (current) to the coil 33 of the electromagnetic coil 9 in accordance with a fuel injection timing at which the fuel is jetted in the combustion chamber, calculated based on information from a crank angle sensor that detects a crank angle.

The yoke 10 has a hollow penetration bore, and is formed by the following three sections; a large diameter section 35 formed at an upstream side opening portion of the yoke 10, a medium diameter section 36 formed to be smaller than the large diameter section 35 and a small diameter section 37 formed to be smaller than the medium diameter section 36 and formed at a downstream side opening portion of the yoke 10. The small diameter section 37 is fitted around an outer circumference of the valve member accommodating part 16. The electromagnetic coil 9 is installed in an inner circumference of the medium diameter section 36. A coupling core 38 is placed in an inner circumference of the large diameter section 35.

The coupling core 38 is made of magnetic metal material etc., and is shaped like a letter "C". The yoke 10 connects with or touches the magnetic cylinder 2 through the small diameter section 37 and the large diameter section 35 via the coupling core 38. That is, the yoke 10 magnetically connects with the magnetic cylinder 2 at both end portions of the electromagnetic coil 9. An adapter 52 to secure the fuel injection valve 1 to an intake valve of the engine is attached to a downstream side top end of the yoke 10.

When applying the current to the electromagnetic coil 9 through the connector pin 34, magnetic field occurs, and the valve body 4 and the valve stem 5 are moved against a spring force of the coil spring 29 by a magnetic force of this magnetic field, then the fuel injection valve 1 opens.

The fuel injection valve 1 is provided with a resin cover 53. As shown in FIG. 1, the resin cover 53 covers the large diameter part 11 of the magnetic cylinder 2 except an upstream side of the large diameter part 11, the small diameter part 12 of the magnetic cylinder 2 up to a setting position of the electromagnetic coil 9 and a part of the medium diameter section 36 in which the electromagnetic coil 9 is installed. Further, a space between an outer circumference of the coupling core 38 and the large diameter section 35, an outer circumference of the large diameter section 35, an outer circumference of the medium diameter section 36, and an outer circumference of the connector pin 34 are covered or filled with the resin cover 53. A top end portion of the connector pin 34 is not covered with the resin cover 53, but an opening is formed around the connector pin 34 in order for a connector of a control unit to be plugged into this opening.

An O-ring 39 is provided on an upstream side outer circumference of the magnetic cylinder 2. In addition, an O-ring 40 is provided on an upstream side outer circumference of the small diameter section 37 of the yoke 10.

[Structure of the Nozzle Plate]

Figure 3:
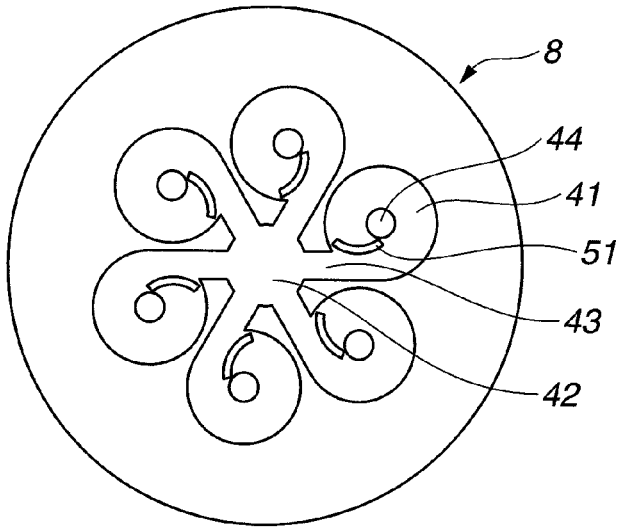
FIG. 3 is a top view of the nozzle plate, viewed from an upstream side, of the embodiment 1.
Figure 4:
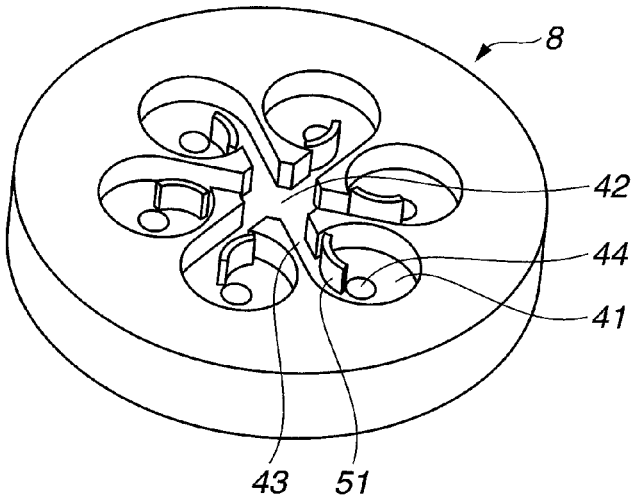
FIG. 4 is a perspective view of the nozzle plate, of the embodiment 1.
Figure 5:
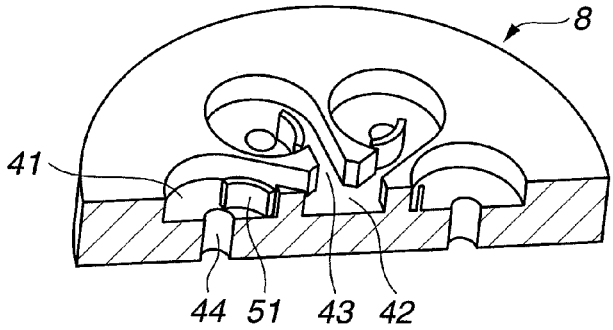
FIG. 5 is a perspective view of the nozzle plate, cut in half in the axial direction, of the embodiment 1.
Figure 6:
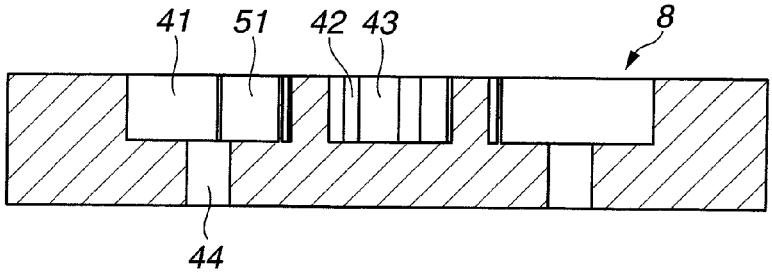
FIG. 6 is a sectional view of the nozzle plate, cut in the axial direction, of the embodiment 1.

FIG. 3 is a top view of the nozzle plate 8, viewed from the upstream side. FIG. 4 is a perspective view of the nozzle plate 8. FIG. 5 is a perspective view of the nozzle plate 8, cut in half in the axial direction. FIG. 6 is a sectional view of the nozzle plate 8, cut in the axial direction.

As mentioned above, the swirl chambers 41 and the fuel distribution chamber 42 are formed on the upstream side of the nozzle plate 8. The orifice nozzle 44 for each swirl chamber 41 is formed on the downstream side of the nozzle plate 8.

The fuel distribution chamber 42 is a circular hollow (a circular depressed or recessed portion) on the upstream side of the nozzle plate 8. As can be seen in the drawings (especially, FIG. 2), the fuel distribution chamber 42 is arranged concentrically with the communication hole 50 of the mid-plate 49 so that both openings of the fuel distribution chamber 42 and the communication hole 50 are fitted to each other. That is, a diameter of the fuel distribution chamber 42 are set to the same diameter as the communication hole 50.

The swirl chamber 41 is also formed into a circular hollow shape (a circular depressed or recessed shape) on the upstream side of the nozzle plate 8. In the embodiment 1, six swirl chambers 41 are arranged in a circumferential direction at an outer circumference side of the fuel distribution chamber 42 at regular intervals. The swirl chamber 41 has the communication conduit 43, and communicates with the fuel distribution chamber 42 through this communication conduit 43. On an inside diameter side of the swirl chamber 41 (on a bottom surface of the swirl chamber 41), the orifice nozzle 44 through which the swirl chamber 41 communicates with the downstream side of the nozzle plate 8 is formed.

As described above, the communication conduit 43 extends from the fuel distribution chamber 42 to the swirl chamber 41 and connects these fuel distribution chamber 42 and swirl chamber 41. An extending or connecting direction of the communication conduit 43 is a tangential direction of an inner side surface (a cylindrical inner side surface) of the swirl chamber 41 at a connecting position (or connecting point) between the communication conduit 43 and the swirl chamber 41. That is to say, the communication conduit 43 is formed so that the fuel distributed from the communication conduit 43 flows along an inner wall of the swirl chamber 41. In the swirl chamber 41, a fuel inflow prevention wall 51 is provided around a connecting area where the communication conduit 43 connects with the swirl chamber 41.

(Detail of Position of the Orifice Nozzle and the Fuel Inflow Prevention Wall)

Figure 7:
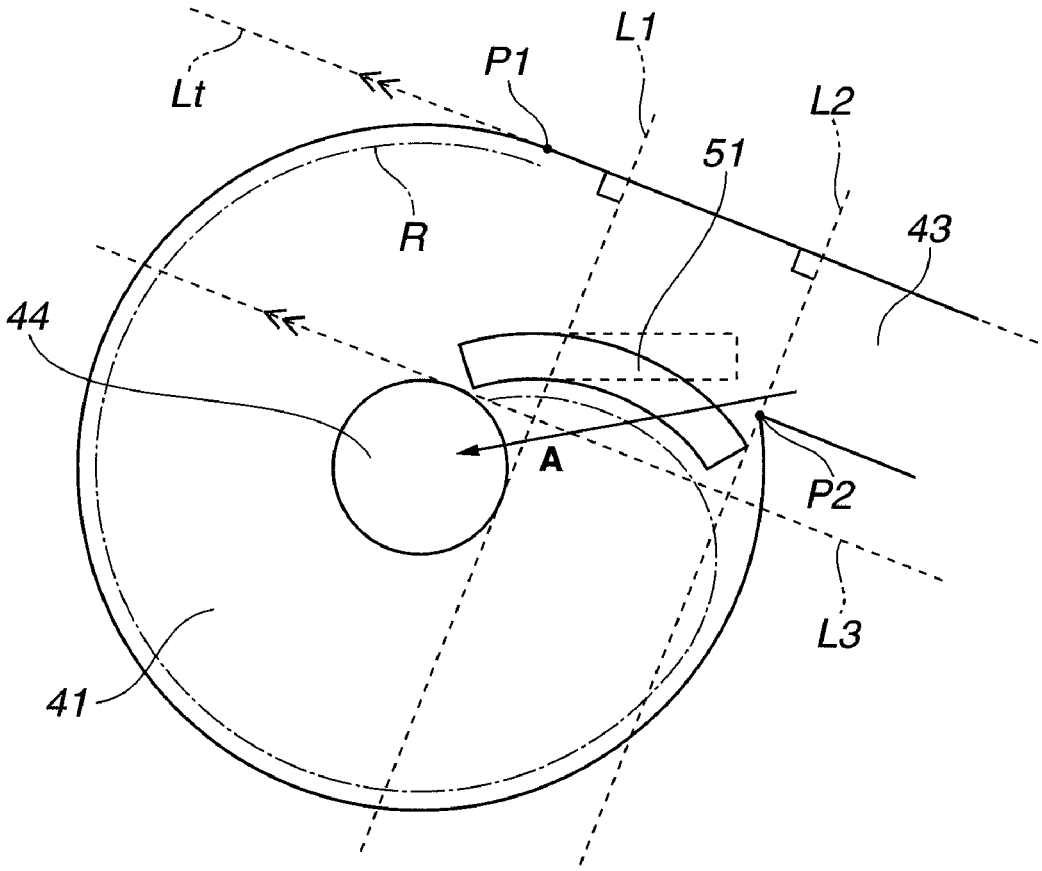
FIG. 7 is a drawing for explaining a setting position of an inflow prevention wall, of the embodiment 1.

FIG. 7 is a drawing for explaining a setting position of the fuel inflow prevention wall 51. The fuel inflow prevention wall 51 is a wall which prevents the incoming fuel from the communication conduit 43 from directly flowing into the orifice nozzle 44 and also suppresses a collision between a fuel flow swirling inside the swirl chamber 41 (i.e. a flow of the fuel that swirls and comes to the connecting area where the fuel inflow prevention wall 51 is set) and a fuel flow coming from the communication conduit 43 (i.e. a flow of the fuel that flows from the communication conduit 43 into the swirl chamber 41).

Here, to explain the setting position of the fuel inflow prevention wall 51, dotted lines etc. shown in FIG. 7 will be explained. In the following, as shown in FIG. 7, the explanation will be made on the basis of the drawing of the swirl chamber 41 viewed from the axial direction.

As described above, the extending direction of the communication conduit 43 is the tangential direction of the inner side surface of the swirl chamber 41 at the connecting position between the communication conduit 43 and the swirl chamber 41. That is, one inner side surface of the communication conduit 43 and the inner side surface of the swirl chamber 41 are connected at a point P1 (hereinafter called a first connecting point P1) in FIG. 7. The other inner side surface of the communication conduit 43 connects with the inner side surface of the swirl chamber 41 at a point P2 (hereinafter called a second connecting point P2) that differs from the first connecting point P1.

A tangent of the inner side surface of the swirl chamber 41 at the first connecting point P1 is called a tangent Lt.

A tangent of the orifice nozzle 44, which is perpendicular to the tangent Lt and is closer to the second connecting point P2, is a first straight line L1 (although there are two tangents of the orifice nozzle 44 which are perpendicular to the tangent Lt, the first straight line L1 is the line whose distance to the second connecting point P2 is shorter than the other).

A straight line which passes through the second connecting point P2 and is perpendicular to the direction of the tangent Lt is a second straight line L2.

A tangent of the orifice nozzle 44, which is parallel to the tangent Lt and is closer to the first connecting point P1, is a third straight line L3 (although there are two tangents of the orifice nozzle 44 which are parallel to the tangent Lt, the third straight line L3 is the line whose distance to the first connecting point P1 is shorter than the other).

The orifice nozzle 44 is positioned at a center side with respect to the second straight line L2 in the swirl chamber 41. Under this orifice nozzle setting condition, the fuel inflow prevention wall 51 is set at a first connecting point P1 side with respect to the third straight line L3 with the fuel inflow prevention wall 51 ranging or extending from the first straight line L1 to the second straight line L2. In the embodiment 1, a top end of the fuel inflow prevention wall 51, which is positioned at an orifice nozzle 44 side, extends across the first straight line L1 toward the orifice nozzle 44. That is, the fuel inflow prevention wall 51 is formed so that, by the fuel inflow prevention wall 51, the flow of the fuel swirling and coming to the connecting area is prevented from heading toward the fuel flow coming from the communication conduit 43. In other wards, the fuel inflow prevention wall 51 is formed so as to lessen the heading of the fuel flow swirling inside the swirl chamber 41 toward the fuel flow coming from the communication conduit 43.

In addition, the fuel inflow prevention wall 51 is formed so that the top end (a first straight line L1 side top end) of the fuel inflow prevention wall 51, positioned at the orifice nozzle 44 side, curves toward an inner circumferential side of the swirl chamber 41. That is, the fuel inflow prevention wall 51 is formed so that the incoming fuel from the communication conduit 43 easily flows in a swirling direction along the fuel inflow prevention wall 51 in the swirl chamber 41.

On the other hand, as for the other top end (a second straight line L2 side top end) of the fuel inflow prevention wall 51, the second straight line L2 side top end curves toward the inner circumferential side of the swirl chamber 41. That is, the fuel inflow prevention wall 51 is formed so that a fuel flowing path (or route) of the incoming fuel from the communication conduit 43 can be secured in the swirl chamber 41 by the fuel inflow prevention wall 51. Here, in a case where the second straight line L2 side top end of the fuel inflow prevention wall 51 does not curve toward the inner circumferential side of the swirl chamber 41, i.e. in a case of the fuel inflow prevention wall 51 shown by a dotted line in FIG. 7, the incoming fuel from the communication conduit 43 directly flows into the orifice nozzle 44, as shown by an arrow A.

Further, a shape of a route (a route R shown by a dashed line) reaching from the first connecting point P1 to the fuel inflow prevention wall 51 (the first straight line L1 side top end of the fuel inflow prevention wall 51) along the inner side surface of the swirl chamber 41 is formed into an involute curve (or a spiral shape).

[Function]

Next, function of the fuel inflow prevention wall 51 in the fuel injection valve 1 will be explained.

(Increase of Swirling Energy of Fuel)

Figure 8A:
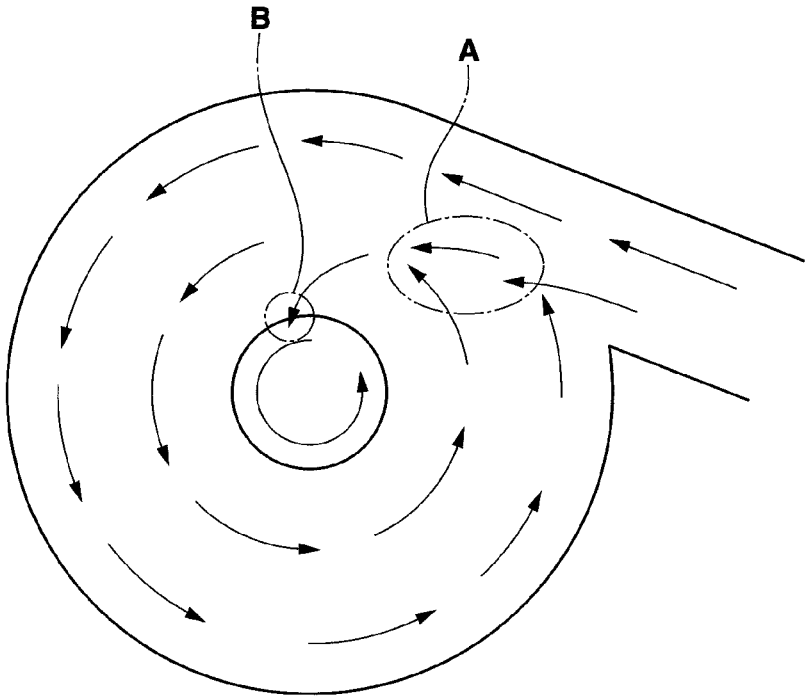
FIGS. 8A and 8B are drawings showing a fuel flow for comparison between a case where no inflow prevention wall is provided (FIG. 8A) and a case where the inflow prevention wall is provided (FIG. 8B).
Figure 8B:
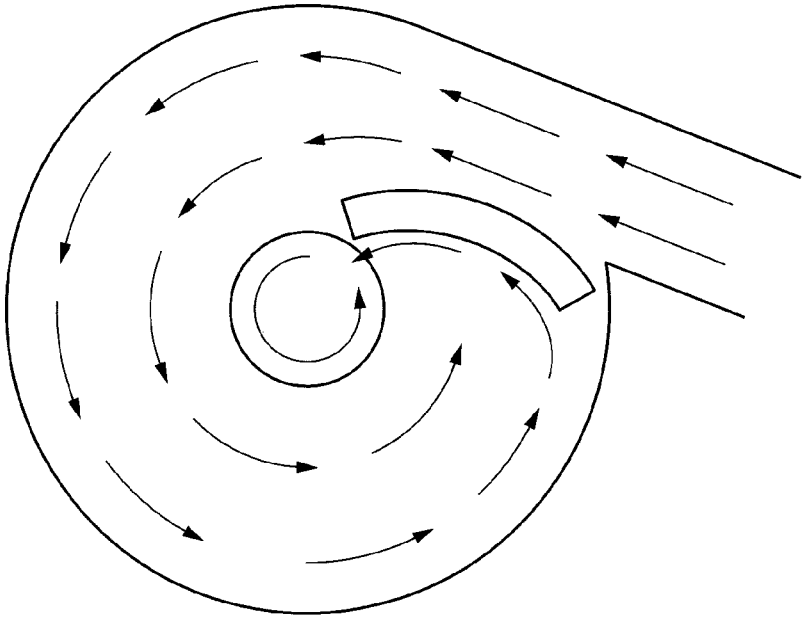

FIGS. 8A and 8B are drawings showing the fuel flow for comparison between a case where no fuel inflow prevention wall is provided (FIG. 8A) and a case where the fuel inflow prevention wall 51 is provided (FIG. 8B). In the drawings, arrows schematically indicate the fuel flow. Further, to facilitate the understanding of the difference between both fuel flows, each reference sign is not shown.

In FIG. 8A, as shown by "A", since there is a certain distance from a connecting part between the swirl chamber 41 and the communication conduit 43 to the orifice nozzle 44, the collision between the flow of the fuel swirling and coming to the connecting part and the flow of the incoming fuel from the communication conduit 43 occurs. For this reason, a velocity of the flow in the swirling direction of the fuel is decreased at this collision point, and the swirling energy of the fuel lowers.

Further, as mentioned above, since a certain distance from the connecting part between the swirl chamber 41 and the communication conduit 43 to the orifice nozzle 44 is present, as shown by "B", the incoming fuel from the communication conduit 43 directly flows into the orifice nozzle 44 without swirling inside the swirl chamber 41. Because of this, the fuel cannot be provided with a sufficient swirling energy before being jetted out from the orifice nozzle 44.

In the case of FIG. 8A, when the fuel whose swirling energy is small flows into the orifice nozzle 44, the fuel cannot form a thin layer (or film) in the orifice nozzle 44, and there might arise a problem that a size of sprayed or atomized fuel particle becomes large. Therefore in the fuel injection valve 1 of the embodiment 1, in the condition in which the orifice nozzle 44 is positioned at the center side with respect to the second straight line L2 in the swirl chamber 41, the fuel inflow prevention wall 51 is set at the first connecting point P1 side with respect to the third straight line L3 with the fuel inflow prevention wall 51 ranging or extending from the first straight line L1 to the second straight line L2.

As shown in FIG. 8B, by providing the fuel inflow prevention wall 51 in the swirl chamber 41, the flow of the fuel swirling and coming to the connecting part can be prevented from heading toward the fuel flow coming from the communication conduit 43 by the fuel inflow prevention wall 51. As a consequence, the decrease of the velocity of the flow in the swirling direction of the fuel can be suppressed, and this allows an increase in the swirling energy of the fuel when flowing into the orifice nozzle 44.

Further, by the fuel inflow prevention wall 51, it is possible to prevent the flow of the fuel that flows from the communication conduit 43 into the swirl chamber 41 from heading for the orifice nozzle 44. That is to say, the incoming fuel from the communication conduit 43 can be prevented from directly flowing into the orifice nozzle 44 without swirling inside the swirl chamber 41. This allows the increase in the swirling energy of the fuel when flowing into the orifice nozzle 44.

With this configuration or structure, the fuel sufficiently provided with the swirling energy flows into the orifice nozzle 44, thereby facilitating the generation of minute atomized fuel particles.

(Facilitation of Swirl of the Fuel)

It is desirable for the generation of the minute atomized fuel particles to swirl the fuel well inside the swirl chamber 41.

Thus, in the fuel injection valve 1 in the embodiment 1, the fuel inflow prevention wall 51 is formed so that the first straight line L1 side top end of the fuel inflow prevention wall 51 curves toward the inner circumferential side of the swirl chamber 41. With this structure, the incoming fuel from the communication conduit 43 flows along the fuel inflow prevention wall 51 in the swirl chamber 41, and this swirls the fuel inside the swirl chamber 41 efficiently. Through this mechanism, the generation of the minute atomized fuel particles can be facilitated.

Further, in the fuel injection valve 1 in the embodiment 1, the shape of the route reaching from the first connecting point P1 to the fuel inflow prevention wall 51 along the inner side surface of the swirl chamber 41 is formed into the involute curve (or the spiral shape). With this shape, the incoming fuel from the communication conduit 43 flows along the inner side surface of the swirl chamber 41 and a side surface of the fuel inflow prevention wall 51 in the swirl chamber 41, and this swirls the fuel inside the swirl chamber 41 efficiently. Through this mechanism, the generation of the minute atomized fuel particles can be facilitated.

Moreover, the second straight line L2 side top end of the fuel inflow prevention wall 51 curves toward the inner circumferential side of the swirl chamber 41. With this, the fuel in the swirl chamber 41 smoothly flows along the second straight line L2 side top end of the fuel inflow prevention wall 51. Consequently, the fuel inside the swirl chamber 41 swirls efficiently, and the generation of the minute atomized fuel particles can be facilitated.

(Reduction of Dead Volume)

During the valve closure of the fuel injection valve, the fuel remains in the swirl chamber 41, the fuel distribution chamber 42, the communication conduit 43 and the orifice nozzle 44. A space where the fuel remains during the valve closure is called a dead space. The remaining fuel causes decrease in precision of the fuel injection, increase of hydrocarbon due to incomplete combustion, deterioration in response of the open/close valve at a low pulse control, and increase in size of the sprayed or atomized fuel particle during an early stage of the fuel injection.

Figure 9:
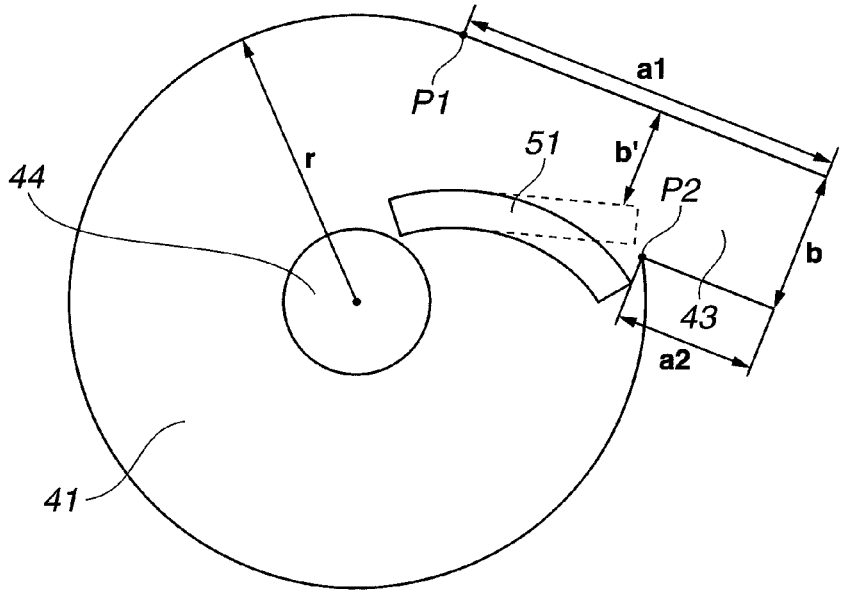
FIG. 9 is a drawing indicating each length of parts for determining volumes of a swirl chamber and a communication conduit, of the embodiment 1.

To reduce the remaining fuel, reduction of a volume of the dead space is required. FIG. 9 is a drawing indicating each length of parts for determining volumes of the swirl chamber 41 and the communication conduit 43.

A length from a connecting portion between the communication conduit 43 and the fuel distribution chamber 42 to the first connecting point P1 is "a1". A length from the connecting portion between the communication conduit 43 and the fuel distribution chamber 42 to the second connecting point P2 is "a2". An opening length of the communication conduit 43, at a fuel distribution chamber 42 side, is "b". A radius of the swirl chamber 41 is "r". Heights (or depths) of the swirl chamber 41 and the communication conduit 43 are both "h".

When the volume of the swirl chamber 41 is Vs, the volume Vs of the swirl chamber 41 is approximately expressed by the following expression.

$$Vs=r^2\times\pi\times h$$

When the volume of the communication conduit 43 is Vr, the volume Vr of the communication conduit 43 is approximately expressed by the following expression.

$$Vr=(a1+a2)/2\times b\times h$$

Here, in order to secure a flow amount of the fuel supplied to the swirl chamber 41, it is preferable that an area of the opening of the communication conduit 43, at the fuel distribution chamber 42 side, be as great as possible. To set the area of the opening of the communication conduit 43 to be great, the height "h" or the length "b" is required to be set to be large.

As expressed by the above expressions, if the height "h" is set to be large, not only the volume Vr of the communication conduit 43 but also the volume Vs of the swirl chamber 41 become great, then the dead volume is increased. On the other hand, if the length "b" is set to be large, only the volume Vr of the communication conduit 43 becomes great, and increase in the dead volume can be suppressed.

However, if the length "b" is set to be large, the communication conduit 43 broadens to the orifice nozzle 44 side. In this case, the fuel directly flows from the communication conduit 43 to the orifice nozzle 44 easily.

Therefore, in the embodiment 1, the fuel inflow prevention wall 51 is formed so that the second straight line L2 side top end of the fuel inflow prevention wall 51 curves toward the inner circumferential side of the swirl chamber 41. With this structure, as compared with a length "b'" of the communication conduit 43 of a case where a shape of the second straight line L2 side top end of the fuel inflow prevention wall 51 is straight shape as shown by a dotted line in FIG. 9, the length of the conduit width "b" of the communication conduit 43 can be sufficiently secured, and a channel volume of the communication conduit 43 can be increased. Hence, since the length of the conduit width "b" of the communication conduit 43 is larger than the length "b'" of the communication conduit 43 of the case of the fuel inflow prevention wall 51 shown by the dotted line, the fuel inflow amount to the swirl chamber 41 can be increased without widening the conduit width "b" of the communication conduit 43 while suppressing the increase in the dead volume.

[Effects]

Effects of the present invention are recited as follows.

(1) A fuel injection valve 1 has a valve body 4; a valve seat member 7 which slidably accommodates therein the valve body 4 and has (a) a valve seat 6 on which the valve body 4 is seated during valve closure; and (b) an opening portion 48 formed at a downstream side of the valve seat member 7; a swirl chamber 41 which is formed into a circular hollow shape at a downstream side of the opening portion 48 of the valve seat member 7 and has a cylindrical inner side surface, the swirl chamber 41 providing swirl to fuel; an orifice nozzle 44 which is formed into a cylindrical shape at a bottom of the swirl chamber 41, and from which the fuel is jetted; a communication conduit 43 through which the swirl chamber 41 communicates with the opening portion 48 of the valve seat member 7, the communication conduit 43 extending toward a tangential direction Lt of the swirl chamber 41 and connecting with the swirl chamber 41; and a fuel inflow prevention wall 51 which is provided at a connecting area between the communication conduit 43 and the swirl chamber 41. And when setting a first connecting point P1, a second connecting point P2, a first straight line L1, a second straight line L2 and a third straight line L3, viewed from an axial direction of the swirl chamber 41, in the swirl chamber 41, as follows; the first connecting point P1 is a connecting point between the communication conduit 43 and the inner side surface of the swirl chamber 41 on a tangent Lt of the swirl chamber 41, the second connecting point P2 is a connecting point between the communication conduit 43 and the inner side surface of the swirl chamber 41, which differs from the first connecting point P1, the first straight line L1 is a tangent of the orifice nozzle 44, which is perpendicular to a direction of the tangent Lt of the inner side surface of the swirl chamber 41 on the first connecting point P1 and is closer to the second connecting point P2, the second straight line L2 is a straight line which passes through the second connecting point P2 and is perpendicular to the direction of the tangent Lt of the inner side surface of the swirl chamber 41 on the first connecting point P1, and the third straight line L3 is a tangent of the orifice nozzle 44, which is parallel to the direction of the tangent Lt of the inner side surface of the swirl chamber 41 on the first connecting point P1 and is closer to the first connecting point P1, the orifice nozzle 44 is positioned at a center side with respect to the second straight line L2 in the swirl chamber 41, and the fuel inflow prevention wall 51 is set at a first connecting point P1 side with respect to the third straight line L3 with the fuel inflow prevention wall 51 extending from the first straight line L1 to the second straight line L2.

Hence, the fuel sufficiently provided with the swirling energy flows into the orifice nozzle 44, thereby facilitating the generation of minute atomized fuel particles.

(2) The fuel inflow prevention wall 51 is formed so that a first straight line L1 side top end of the fuel inflow prevention wall 51 curves toward an inner circumferential side of the swirl chamber 41.

Therefore, the incoming fuel from the communication conduit 43 flows along the fuel inflow prevention wall 51 in the swirl chamber 41, and this swirls the fuel inside the swirl chamber 41 efficiently. Through this mechanism, the generation of the minute atomized fuel particles can be facilitated.

(3) The fuel inflow prevention wall 51 is formed so that a second straight line L2 side top end of the fuel inflow prevention wall 51 curves toward an inner circumferential side of the swirl chamber 41.

As a consequence, the length of the conduit width "b" of the communication conduit 43 can be sufficiently secured, and the fuel inflow amount to the swirl chamber 41 can be increased while suppressing the increase in the dead volume.

(4) A shape of a route of fuel flow, reaching from the first connecting point P1 to the fuel inflow prevention wall 51 along the inner side surface of the swirl chamber 41, is formed into an involute curve (or a spiral shape).

Thus, the incoming fuel from the communication conduit 43 flows along the inner side surface of the swirl chamber 41 and a side surface of the fuel inflow prevention wall 51 in the swirl chamber 41, and this swirls the fuel inside the swirl chamber 41 efficiently. Through this mechanism, the generation of the minute atomized fuel particles can be facilitated.

[Other Embodiments]

The present invention has been explained above on the basis of the embodiment 1. However, configuration or structure of each element is not limited to that of the embodiment 1.

Figure 10:
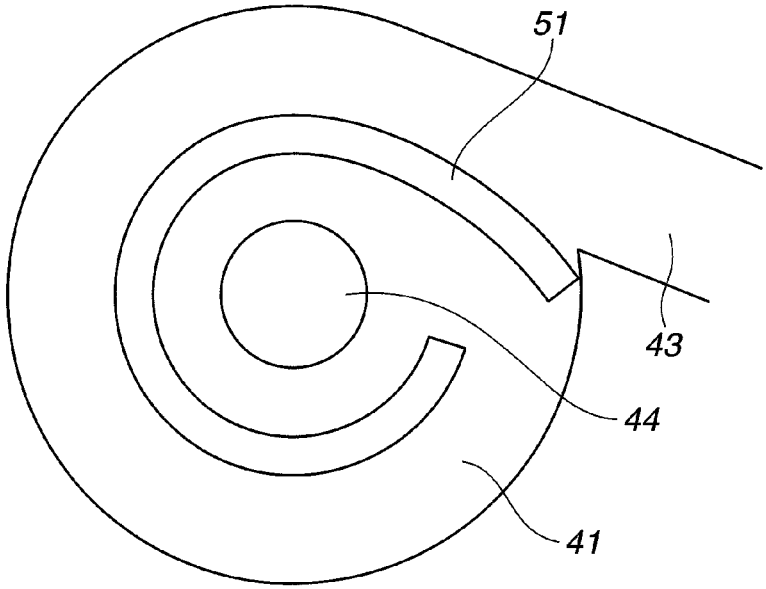
FIG. 10 is a drawing showing a swirl chamber according to other embodiment.

FIG. 10 is a drawing showing the swirl chamber 41. In the fuel injection valve 1 of the embodiment 1, the fuel inflow prevention wall 51 is formed so that the orifice nozzle 44 side (the first straight line L1 side) top end of the fuel inflow prevention wall 51 extends across the first straight line L1. However, as shown in FIG. 10, the fuel inflow prevention wall 51 could be formed so that the fuel inflow prevention wall 51 extends throughout the entire fuel channel or fuel flow route inside the swirl chamber 41.

Figure 11:
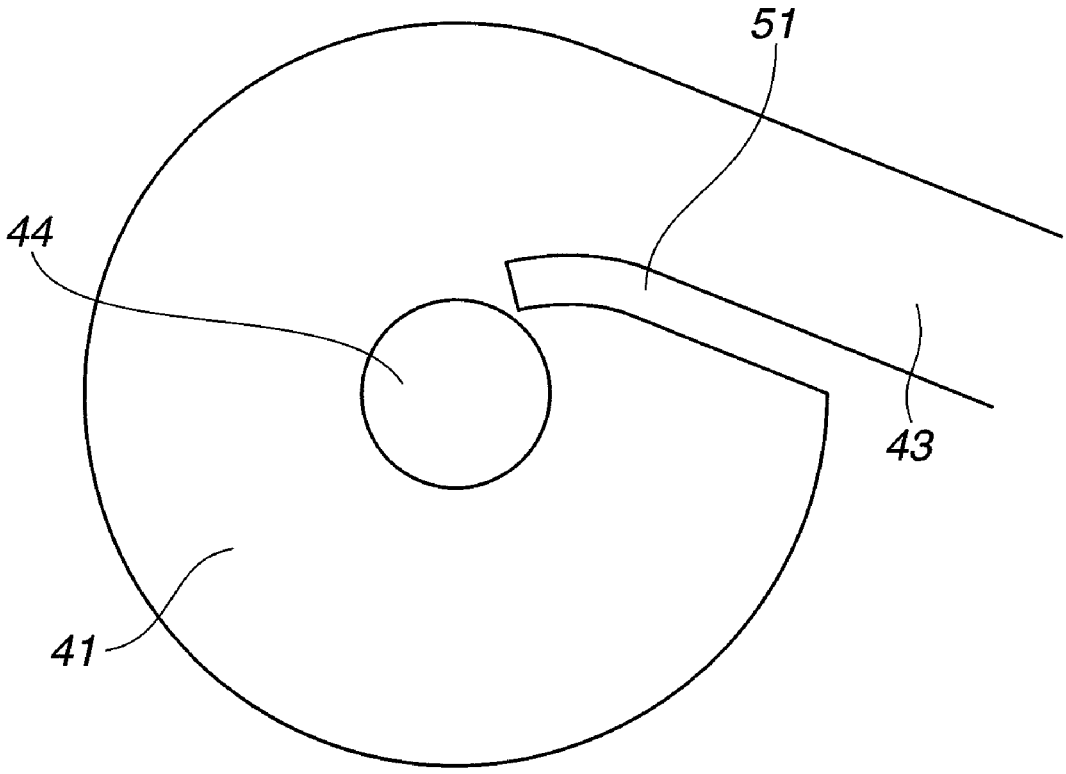
FIG. 11 is a drawing showing a swirl chamber according to other embodiment.

FIG. 11 is a drawing showing the swirl chamber 41. In the fuel injection valve 1 of the embodiment 1, the communication conduit 43 side (the second straight line L2 side) top end of the fuel inflow prevention wall 51 is separated from the inner wall of the swirl chamber 41. However, as shown in FIG. 11, the fuel inflow prevention wall 51 could be formed so that the communication conduit 43 side top end of the fuel inflow prevention wall 51 is fixedly connected with the inner wall of the swirl chamber 41.

Further, the communication conduit 43 side top end of the fuel inflow prevention wall 51 is not formed integrally with the inner wall of the swirl chamber 41 as shown in FIG. 11, but the communication conduit 43 side top end could touch or be contiguous to the inner wall of the swirl chamber 41 as shown in FIG. 10.

In the embodiment 1, the both top ends of the fuel inflow prevention wall 51 curve toward the inner circumferential side of the swirl chamber 41. However, either one or both of the top ends of the fuel inflow prevention wall 51 might be formed into straight line.

Furthermore, in the embodiment 1, the fuel injection valve 1 has the mid-plate 49. However, if liquid tightness of the swirl chamber 41 can be ensured by the valve seat member 7, this could eliminate the need for the mid-plate 49.

In addition, although the swirl chamber 41 is formed on the nozzle plate 8 in the fuel injection valve 1 of the embodiment 1, the swirl chamber 41 could be formed on a downstream side surface of the valve seat member 7.

The entire contents of Japanese Patent Application No. 2010-066554 filed on Mar. 23, 2010 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A fuel injection valve comprising:

a valve body;

a valve seat member which slidably accommodates therein the valve body and has (a) a valve seat on which the valve body is seated during valve closure; and (b) an opening portion formed at a downstream side of the valve seat member;

a swirl chamber which is formed into a circular hollow shape at a downstream side of the opening portion of the valve seat member and has a cylindrical inner side surface, the swirl chamber providing swirl to fuel;

an orifice nozzle which is formed into a cylindrical shape at a bottom of the swirl chamber, and from which the fuel is jetted;

a communication conduit through which the swirl chamber communicates with the opening portion of the valve seat member, the communication conduit extending toward a tangential direction of the swirl chamber and connecting with the swirl chamber; and a fuel inflow prevention wall which is provided at a connecting area between the communication conduit and the swirl chamber, and when setting a first connecting point, a second connecting point, a first straight line, a second straight line and a third straight line, viewed from an axial direction of the swirl chamber, in the swirl chamber, as follows;

the first connecting point is a connecting point between the communication conduit and the inner side surface of the swirl chamber on a tangent of the swirl chamber, the second connecting point is a connecting point between the communication conduit and the inner side surface of the swirl chamber, which differs from the first connecting point, the first straight line is a tangent of the orifice nozzle, which is perpendicular to a direction of the tangent of the inner side surface of the swirl chamber on the first connecting point and is closer to the second connecting point, the second straight line is a straight line which passes through the second connecting point and is perpendicular to the direction of the tangent of the inner side surface of the swirl chamber on the first connecting point, and the third straight line is a tangent of the orifice nozzle, which is parallel to the direction of the tangent of the inner side surface of the swirl chamber on the first connecting point and is closer to the first connecting point, the orifice nozzle being positioned at a center side with respect to the second straight line in the swirl chamber, and the fuel inflow prevention wall being set at a first connecting point side with respect to the third straight line with the fuel inflow prevention wall extending from the first straight line to the second straight line.

2. The fuel injection valve as claimed in claim 1, wherein:

the fuel inflow prevention wall is formed so that a first straight line side top end of the fuel inflow prevention wall curves toward an inner circumferential side of the swirl chamber.

3. The fuel injection valve as claimed in claim 1, wherein:

the fuel inflow prevention wall is formed so that a second straight line side top end of the fuel inflow prevention wall curves toward an inner circumferential side of the swirl chamber.

4. The fuel injection valve as claimed in claim 1, wherein:

a shape of a route of fuel flow, reaching from the first connecting point to the fuel inflow prevention wall along the inner side surface of the swirl chamber, is formed into a spiral shape.

5. The fuel injection valve as claimed in claim 2, wherein:

the first straight line side top end of the fuel inflow prevention wall extends throughout an entire fuel flow route inside the swirl chamber.

6. The fuel injection valve as claimed in claim 3, wherein:

the second straight line side top end of the fuel inflow prevention wall is fixedly connected with an inner wall of the swirl chamber.

7. The fuel injection valve as claimed in claim 1, wherein:

either one or both of top ends of the fuel inflow prevention wall is formed into straight line.

8. The fuel injection valve as claimed in claim 1, wherein:

the swirl chamber is formed on a downstream side surface of the valve seat member.

* * * * *